United States Patent [19]

Larsen

[11] Patent Number: 4,553,294

[45] Date of Patent: Nov. 19, 1985

[54] CLIP-TYPE HOOK FASTENING DEVICE

[76] Inventor: Walter L. Larsen, P.O. Box 18302, Seattle, Wash. 98118

[21] Appl. No.: 246,067

[22] Filed: Mar. 20, 1981

Related U.S. Application Data

[62] Division of Ser. No. 28,850, Apr. 10, 1979.

[51] Int. Cl.[4] ..... A41D 27/22; A44B 13/02

[52] U.S. Cl. ..... 24/489; 24/505; 24/509; 24/536; 211/119.12; 223/85; 248/317

[58] Field of Search ..... 24/489, 504, 505, 506, 24/508, 509, 562, 536, 115 R; 211/119.12, 119; 248/317, 318; 223/85, 87, 91

[56] References Cited

U.S. PATENT DOCUMENTS

| | | | |
|---|---|---|---|
| 60,351 | 12/1866 | Fisher | 24/509 |
| 69,398 | 10/1867 | Britton | 24/509 |
| 265,171 | 9/1882 | Sperry . | |
| 763,793 | 6/1904 | Pickert | 24/536 |
| 825,332 | 10/1906 | Mack . | |
| 1,245,756 | 11/1917 | Melhart | 24/489 |
| 1,274,280 | 7/1918 | Koob . | |
| 1,690,614 | 11/1928 | Bower . | |
| 1,761,630 | 6/1930 | Jentzen | 24/562 |
| 2,092,121 | 9/1937 | Johnson . | |
| 2,122,309 | 6/1938 | Beimler | 24/30.5 R |
| 2,166,884 | 7/1939 | White | 24/562 |
| 2,360,164 | 10/1944 | Santora . | |
| 2,442,410 | 6/1948 | Harpole et al. | 211/119.12 |
| 2,473,408 | 6/1949 | Alkin | 24/509 |
| 2,542,224 | 2/1951 | Werner | 24/536 |
| 2,632,930 | 3/1953 | Donahue | 211/119.12 |
| 2,915,274 | 12/1959 | Gustitus . | |
| 3,048,311 | 8/1962 | Neuenfeldt . | |
| 3,058,186 | 10/1962 | Fanning, Jr. | 24/505 |
| 3,184,204 | 5/1965 | Dachinger | 211/119.12 |
| 3,193,235 | 7/1965 | Jensen | 248/317 |
| 3,202,329 | 8/1965 | Schmidt | 211/119.12 |
| 3,240,462 | 3/1966 | Schneider . | |
| 3,527,358 | 9/1970 | Wheeler | 223/85 |
| 3,999,259 | 12/1976 | Paajanen | 24/509 |
| 4,008,835 | 2/1977 | Budzik | 223/85 |
| 4,034,902 | 7/1977 | Grillo | 223/85 |
| 4,139,174 | 2/1979 | Olson | 248/317 |

FOREIGN PATENT DOCUMENTS

| | | | |
|---|---|---|---|
| 1093526 | 11/1960 | Fed. Rep. of Germany | 248/317 |
| 1500741 | 11/1967 | France | 223/85 |
| 768153 | 2/1957 | United Kingdom | 211/119.12 |

*Primary Examiner*—Victor N. Sakran

[57] ABSTRACT

This invention pertains primarily to supplementary fastening devices in the form of jawed openable clips having a slot in one or both jaws used for fastening the hook of a garment hanger or other hook including device to a clothesline or other generally linear member. Certain embodiments can additionally be used for fastening two linear members together in a crossing relationship.

57 Claims, 29 Drawing Figures

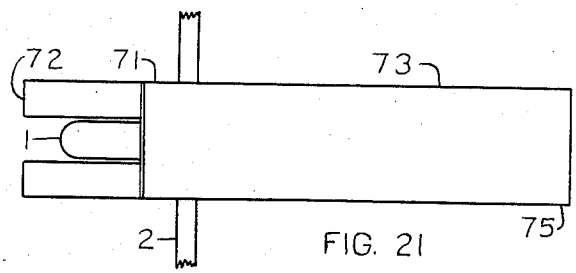
FIG. 21
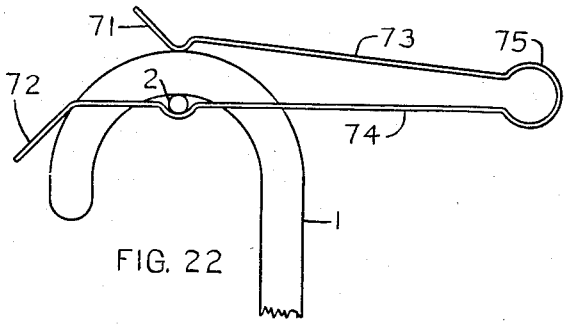
FIG. 22
FIG. 23
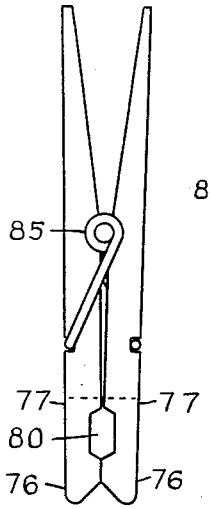
FIG. 24
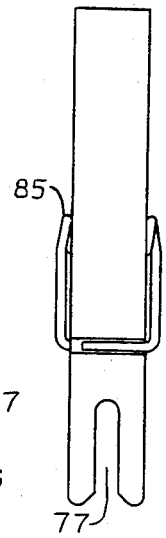
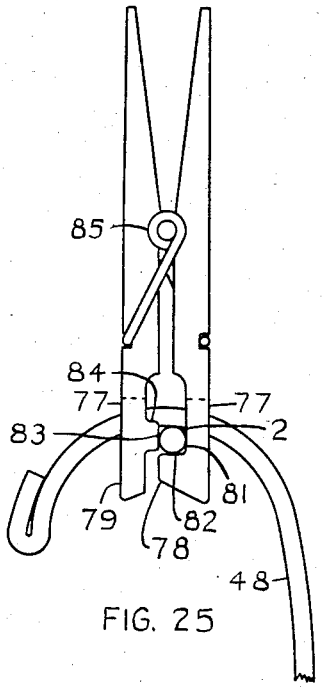
FIG. 25
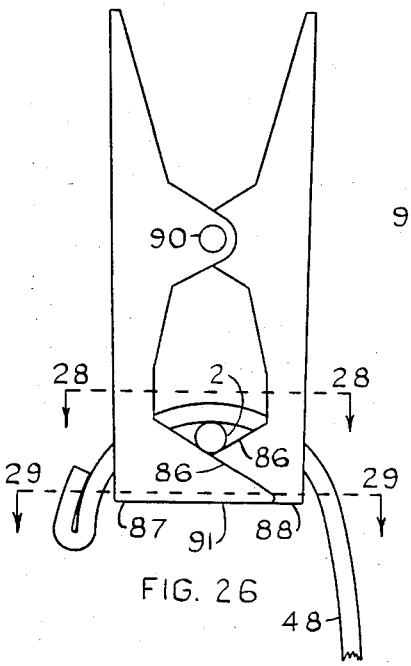
FIG. 26
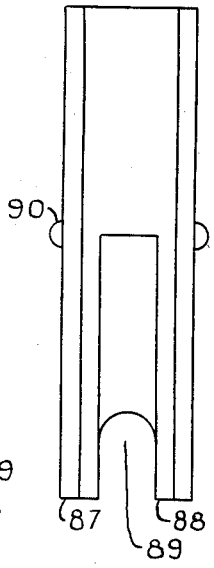
FIG. 27
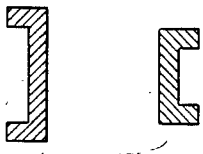
FIG. 28
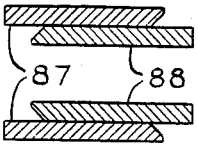
FIG. 29

CLIP-TYPE HOOK FASTENING DEVICE

CROSS REFERENCE TO RELATED APPLICATION

This application is being filed as a result of a requirement for restriction and election on a copending application, Ser. No. 28,850, filed Apr. 10, 1979, entitled Hook Fastening Device, and this application contains subject matter presented in said copending application and is a division thereof.

TECHNICAL FIELD

This invention relates primarily to supplementary fastening devices for securing the hook of a garment hanger or other hook including device or similarly curved member including device to a generally linear member such as a clothesline, cable, rod or the like to which the hook is attached by being hooked to the linear member. It also relates to such devices when used for fastening two generally linear members together. It further relates to devices for fastening an object to a generally linear member comprised of the combination of a hook and a hook fastening device. In addition, it relates to methods for fastening a hook to a linear member, for fastening two linear members together and for fastening an object to a linear member. Finally, it relates to a combination of elements for hingedly connecting the members of a clip-type device together.

BACKGROUND ART

The background art appears to have only distant relevance to this invention. In fact, there does not appear to be any prior art involving supplementary fastening devices for an ordinary type of garment hanger hook or other hooked device which is already attached to a clothesline or other linear member by being hooked to the linear member in the normal manner. Attempts have been made to solve this problem through devices which attach to the clothesline and then, in turn, suspend the hanger hook from the device itself. Examples of devices in this category are U.S. Pat. Nos. 2,092,121; 2,915,274 and 3,184,204. There have also been devices which replace or modify the garment hanger hook in order to more positively fasten the garment hanger to the clothesline, of which the following U.S. Pat. Nos. are examples: 1,690,614; 3,048,311 and 3,240,462. There have been devices which, with some modification, might be adapted to fasten a hook to a linear member as, for example, U.S. Pat. Nos. 265,171; 825,332; 1,274,280 and 2,360,164.

DISCLOSURE OF THE INVENTION

There has long been a need for a fastening device which could fasten a garment hanger or other hook including device to a clothesline or other generally linear member. In the case of garment hangers, they are commonly used for holding various items of clothing while they dry after being washed. When suspended from a clothesline, garment hangers are often blown by the wind along the clothesline. When the clothesline has appreciable sag, all of the suspended garment hangers will usually bunch together at the center or lowest position on the clothesline and thereby retard the drying. In gusty winds, suspended garment hangers are often blown off the clothesline.

Some of the previous attempts to resolve these problems have involved modifications to, or replacement of, the hook of the garment hanger. In some cases this has resulted in a device which could be suspended from a clothesline but which could not be satisfactorily suspended from a larger diameter support. Nearly always, such devices resulted in higher product cost. Other attempts have involved devices which attach to the clothesline and then, in turn, suspend the garment hanger hook from the device itself. These devices appear to be costly and/or ineffectual at retaining the hook in suspension under adverse conditions.

To alleviate problems such as the foregoing, this invention provides a supplementary fastening device for securing the hook of a garment hanger or other hook including device to a clothesline or other linear member after the hook has been hooked to the linear member in the normal manner. This is accomplished by means of a substantially lever-type clip with two jaws, one or both of which are slotted to accomodate the hook within the slot, and which conjointly operate to constrain the hook and the linear member in their hooked-together position. This clip can be configured so that it will fasten two generally linear members together. The clip can also be combined with a hook to form a device for generally fastening an object to a linear member. One species of the clip incorporates a novel means for hingedly connecting the members of a clip-type device together.

It is therefore an object of the present invention to provide a supplementary fastening device for fastening the hook of a garment hanger or other hook or similarly curved member including device to a clothesline or other generally linear member to which the hook is attached by being hooked to the linear member.

It is also an object of this invention to provide a fastening device, for securing a hook or curved member to a generally linear member, which is inexpensive to manufacture and easy to use, which will tend to prevent a hook, which is hooked to a linear member, from being unintentionally unhooked from the linear member, and/or which will tend to prevent a hook, which is hooked to a linear member, from being displaced along the direction of the linear member.

Another object of this invention is to provide a fastening device for fastening two generally linear members together in a generally crossing relationship.

A further object of this invention is to provide a device, comprised of the combination of a hook and a clip-type fastening device, for generally fastening an object to a linear member.

A still further object of this invention is to provide methods for fastening a hook to a linear member, for fastening an object to a linear member or for fastening two generally linear members together.

Another object of this invention is to provide a means for hingedly connecting the members of a clip-type device together.

Other objects and advantages and a fuller understanding of the invention may be had by referring to the detailed description hereinafter presented, taken in conjunction with the drawings forming a part hereof, wherein like numerals refer to like parts throughout.

DESCRIPTION OF THE DRAWINGS

FIG. 21 is a plan view of the fastening device made of a single piece of sheet metal, shown fastening a garment hanger hook to a clothesline.

FIG. 22 is a side elevational view of the device shown in FIG. 21.

FIG. 23 is a side elevational view of the fastening device having a slot in each jaw and an enclosing aperture to receive the linear member.

FIG. 24 is a view representing either of the devices shown in FIG. 23 or 25 when rotated 90 degrees about their vertical axes.

FIG. 25 is a side elevational view of the fastening device having a slot in each jaw and an "L" shaped internal surface in one jaw, shown fastening a garment hanger hook to a clothesline.

FIG. 26 is a side elevational view of the fastening device having inclined ramp surfaces on the interior of the jaws, shown fastening a garment hanger hook to a clothesline.

FIG. 27 is a view of the device shown in FIG. 26 when rotated 90 degrees about its vertical axis, shown without the garment hanger hook or clothesline.

FIG. 28 is a view of the section at the plane indicated by the line 28—28 of FIG. 26.

FIG. 29 is a view of the section at the plane indicated by the line 29—29 of FIG. 26.

DESCRIPTION OF THE INVENTION

This invention is primarily a device in the form of a jawed openable clip for fastening the hook of a garment hanger or other hook including device to a clothesline or other generally linear member to which the hook is attached by being hooked to the linear member.

Figure 1:
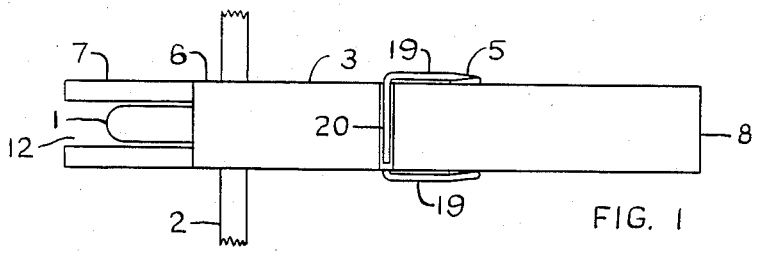
FIG. 1 is a plan view of the clip-type fastening device having a slot shaped opening in one jaw and surface on the other jaw which contacts the garment hanger hook in one location, shown fastening a garment hanger hook to a clothesline.
Figure 2:
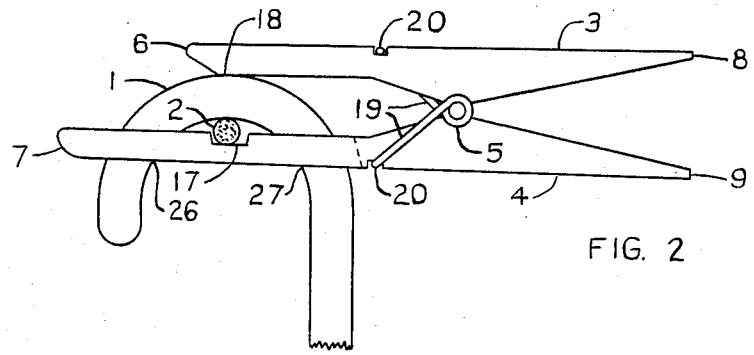
FIG. 2 is a side elevational view of the device shown in FIG. 1, fastening a garment hanger hook to a clothesline.
Figure 3:
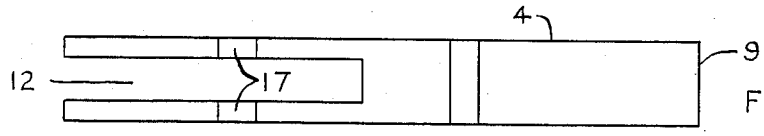
FIG. 3 is a plan view of the primary member having the jaw with the slot shaped opening, being part of the device shown in FIGS. 1 and 2.

FIGS. 1 and 2 show one embodiment of this clip-type fastening device performing its fastening function of fastening a garment hanger hook, 1, to a clothesline, 2. This fastening device is comprised of two primary members, 3 and 4, which are connected together so as to allow generally hinged-type angular relative movement between the primary members. In this case, the primary members, 3 and 4, are hinged together to provide for this relative movement. There are two jaws, 6 and 7, one jaw being combined with each primary member, 3 and 4, respectively, and a force producing member, which is a spring, 5, which functions to urge the two jaws, 6 and 7, toward a closed position. In this case, the spring, 5, is a coil spring of the same general type as is found on the common spring clothespin, with a tangential extension, 19, at each end, each such extension being further bent, 20, at its end in a direction generally parallel to the axis of the spring, and it therefore also serves as the hinge pivot. Each primary member, 3 and 4, is provided with an extending structure, 8 and 9, respectively, which provides handles which can be gripped in the hand and squeezed together to open the jaws, 6 and 7, in the same manner as manipulating a common spring clothespin. One of the jaws, 7, has a generally slot shaped opening, 12, which is of sufficient width and which extends a sufficient distance into the jaw to accomodate the hook, 1, of the garment hanger within this slot shaped opening, 12, as shown. This jaw, 7, together with its generally slot shaped opening, 12, is oriented substantially and primarily in a radial direction in the fastening device. This means that the jaw and its opening extends primarily or largely in a radial direction with respect to a circle centered on an axis which passes through or coincides with the axis of the hinge pivot, 5. The significance of such radial orientation of the jaw and its slotted opening is that this jaw can accomodate the hook, 1, within its slot, 12, in a direction which extends from the end of the jaw toward the hinge pivot, 5, and thus this jaw will not exert a direct clamping force on the hook in the circumferential or closing direction of the fastening device (The circumferential direction is the direction of the circumference of said defined circle at the location of the jaw and such direction is substantially perpendicular to the radial direction). By virtue of its radial orientation and slotted opening, this jaw, 7, is adapted so that it normally contacts the linear member, 2, having surfaces, 17, one on each side of the slotted opening, 12, which contact the undersurface of the clothesline or other linear member, 2, where it passes transversely through the jaw region of the fastening device. These surfaces, 17, on this jaw, 7, are oriented in the jaw so that the clamping direction of this jaw, 7, on the undersurface of the linear member, 2, is substantially or primarily circumferential (or tangential) with respect to said defined circle with the result that the clothesline or other linear member, 2, can be pressed or clamped against the inner surface of the hook, 1, of the garment hanger, by the direct closing force of the jaws as shown. In this case, these surfaces, 17, are located in a depression, at 17, as shown in FIG. 2, into which the clothesline fits so that the clothesline will be retained at a specified distance from the hinge pivot, at 5. The other jaw, 6, has surface, 18, which contacts the outer surface of the hook, 1, of the garment hanger and applies a clamping pressure thereon in a direction which is generally in opposition to the clamping direction of the slotted jaw, 7, against the undersurface of the linear member, 2, with the result that the hook, 1, and the linear member, 2, are clamped together between the jaws, 6 and 7. In this embodiment, this jaw, 6, has surface, 18, which contacts the outer surface of the hook, 1, in generally one location, at 18, as shown in FIG. 2. This location, at 18, is generally about the same distance away from the location, at 5, where the primary members, 3 and 4, are connected together as is the location, at 17, where the other jaw contacts the clothesline. FIG. 3 is a plan view of the lower primary member, 4, showing more clearly the generally slot shaped opening, 12, and the surfaces, 17, located in the depression, at 17, which accomodates the clothesline. This generally slot shaped opening, 12, is of sufficient length in this embodiment to accomodate the hook, 1, of the garment hanger at two locations, 26 and 27, where it passes through the slot as shown in FIG. 2, one location, 26, being outboard and the other location, 27, being inboard of the position occupied by the clothesline, 2.

To use this fastening device, which may be made of a variety of materials including wood and molded plastics, the garment hanger hook, 1, is first suspended from the clothesline, 2, in the normal manner. Then the extending structures, 8 and 9, of the fastening device are squeezed to open the jaws, 6 and 7, and the device is moved so that the hook, 1, of the grament hanger enters into the generally slot shaped opening, 12, and the clothesline, 2, is positioned on the surfaces, 17, in the depression in the jaw. Then the fastening device is released in a fastening position which tends to clamp the clothesline and the garment hanger hook together between the jaws, 6 and 7, as shown in FIG. 2.

Figure 4:
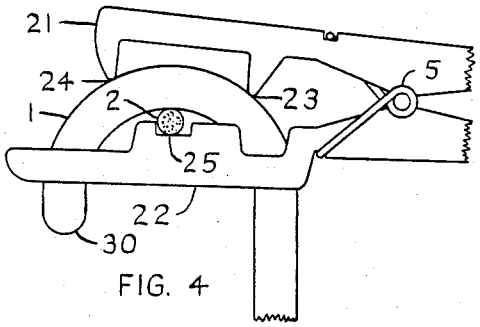
FIG. 4 is a fragmentary side elevational view of the fastening device having a slot shaped opening in one jaw and surface on the other jaw which contacts the garment hanger hook in two locations, shown fastening a garment hanger hook to a clothesline.

The jaws of the fastening device can be modified to change the location where they contact the outer surface of the hook of the garment hanger or other hook including device. FIG. 4 shows a modification in which the jaw, 21, which does not have the slot shaped opening, contacts the hook, 1, in two separated locations, 23 and 24, one location, 23, being inboard and the other location, 24, being outboard of the location, 25, where the jaw which has the slot shaped opening, 22, contacts the linear member, 2. This arrangement adds some stability to the fastening device in its fastening position and it also provides a means tending to restrain the fastening device from shifting position so as to slip off the end, 30, of the hanger hook, 1, when the hook has a section near its end which is straightened out or has less curvature than the curved upper portion of the hook as in the example of FIG. 4. This restraining action occurs because, as the fastening device moves closer to the end, 30, of the hook, that part of the jaw, which is at the outboard location, 24, where the jaw, 21, contacts the hook, 1, is caused to ride up on the straightened portion of the hook and this tends to cause the jaws of the fastening device to open wider against the force of the spring, 5. The reaction to this jaw-opening action is a force which tends to urge the jaws of the fastening device in a direction away from the end, 30, of the hook. Thus this straightened out or reduced curvature section of the hook, 1, near its end, 30, acts as a retaining element which tends to retain the fastening device in its fastening position. Some hanger hooks, instead of having a straightened out section near the end of the hook, have a bent-over end, 31, as, for example, the hanger hook, 48, of FIG. 8. This bent-over end, 31, also forms a retaining element which tends to retain the fastening device in its fastening position.

Figure 5:
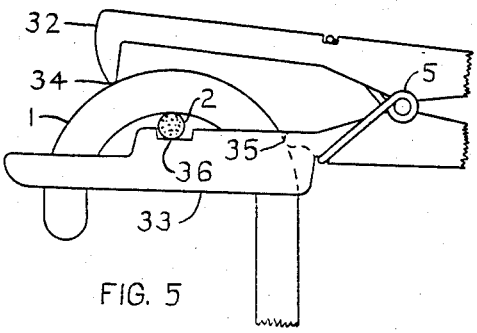
FIG. 5 is a fragmentary side elevational view of the fastening device wherein the jaw with the slot shaped opening and the other jaw each have surface which contacts the garment hanger hook in one location, shown fastening a garment hanger hook to a clothesline.

FIG. 5 shows a modification of the fastening device in which the jaw, 32, which does not have the slot shaped opening, contacts the outer surface of the garment hanger hook, 1, in one location, 34, which is generally outboard of the location, 36, where the other jaw, 33, which has the slot shaped opening, contacts the clothesline, 2, and in which the jaw, 33, which has the slot shaped opening, contacts the outer surface of the hook, 1, at one location, 35, which is generally inboard of the location, 36, of contact with the linear member, 2. As shown in FIG. 5, the location of contact, 35, of the jaw, 33, which has the slot shaped opening, with the hook, 1, may be at that end of the slot shaped opening which is closest to the location, at 5, where the primary members are connected together. This arrangement produces results which are very similar to those described with reference to the device shown in FIG. 4.

Figure 6:
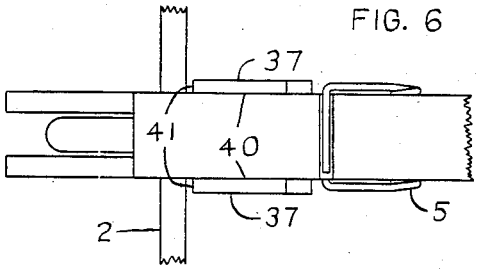
FIG. 6 is a fragmentary plan view of a fastening device, similar to the device shown in FIG. 1, having guide and blocking structure.
Figure 7:
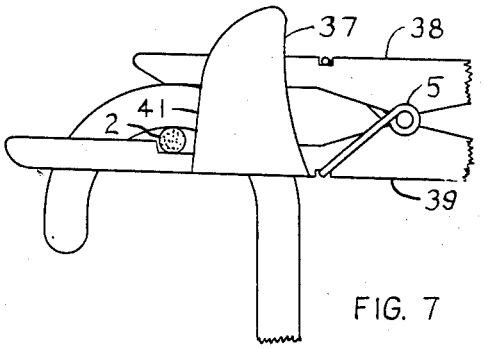
FIG. 7 is a fragmentary side elevational view of the device shown in FIG. 6.

The jaws of the fastening device may be provided with guide structure, 37, as shown in FIGS. 6 and 7. The purpose of this structure, 37, is to stabilize the movement of the jaws. It accomplishes this by presenting surfaces which are attached to one primary member, 39, and which overlap and lie next to part of the other primary member, 38, to form a guide allowing relative movement of the primary members in opening and closing the jaws, but restricting relative sideways displacement of the jaws.

FIGS. 6 and 7 also show linear member retaining structure, 41, which has been added to the jaw of one of the primary members, 39, of the fastening device just inboard of the position occupied by the clothesline, 2, when the device is in its fastening position. The purpose of this linear member retaining structure is to prevent relative movement of the clothesline, 2, to a position closer to the location, at 5, where the primary members are connected together than its intended position as shown in the drawings. In the configuration shown, this linear member retaining structure, 41, is incorporated in, and part of, the guide structure, 37.

It should be noted that the depression, at 17, as shown in FIG. 2, into which the clothesline fits so that the clothesline will be retained at a specified distance from the hinge pivot, at 5, is also a form of linear member retaining structure.

Figures 8, 9, 10, 11, 12, 13, 14, 15, 16, 17, 18, 19, 20:
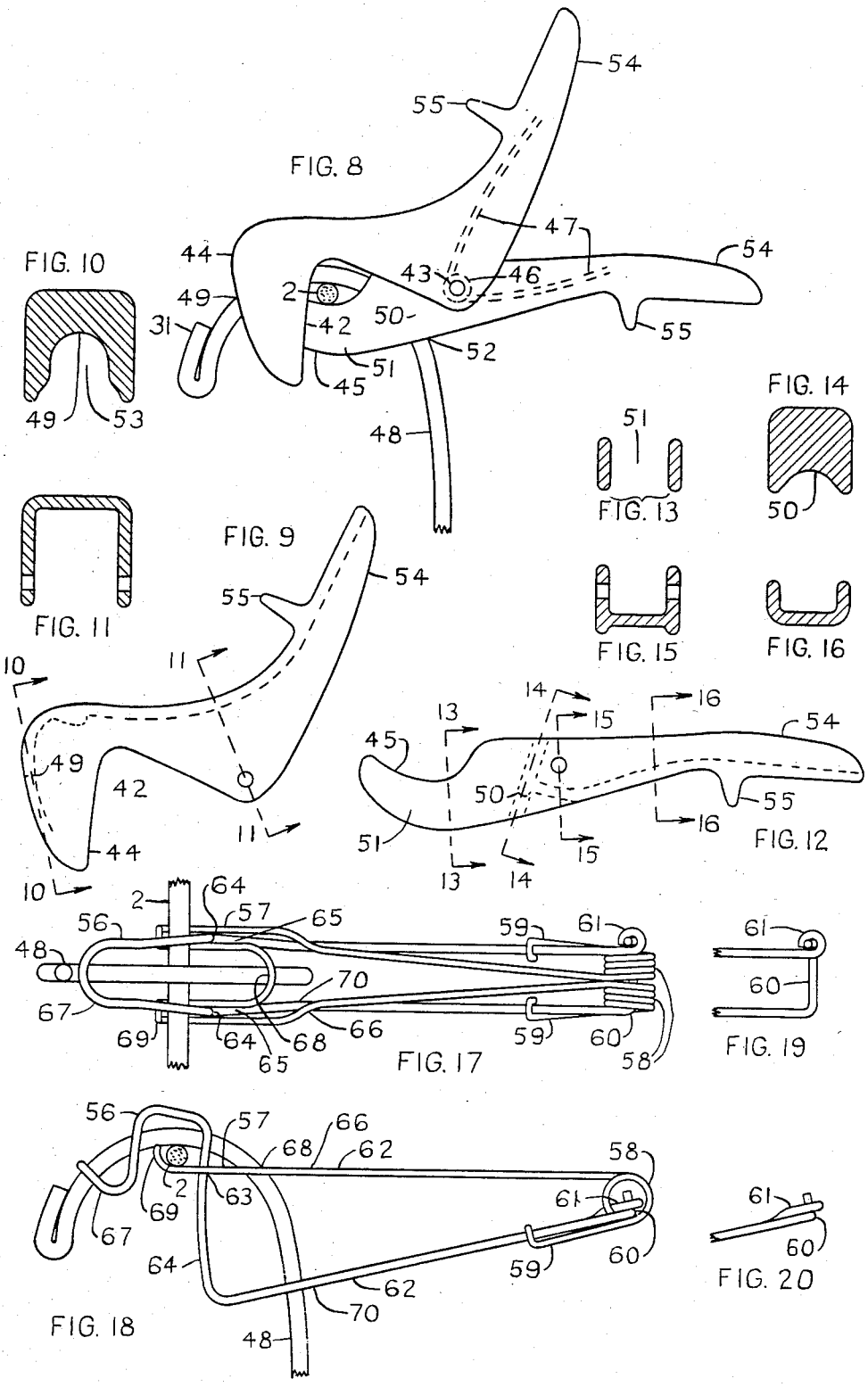
FIG. 8 is a side elevational view of the fastening device having blocking structure located outboard of the linear member position and a confining region on a jaw contacting the garment hanger hook, shown fastening a garment hanger hook to a clothesline.
FIG. 9 is a side elevational view of the primary member having the jaw with the blocking structure and confining region, being part of the device shown in FIG. 8.
FIG. 10 is a view of the section at the plane indicated by the line 10—10 of FIG. 9.
FIG. 11 is a view of the section at the plane indicated by the line 11—11 of FIG. 9.
FIG. 12 is a side elevational view of the primary member having the jaw which normally contacts the linear member, being part of the device shown in FIG. 8.
FIG. 13 is a view of the section at the plane indicated by the line 13—13 of FIG. 12.
FIG. 14 is a view of the section at the plane indicated by the line 14—14 of FIG. 12.
FIG. 15 is a view of the section at the plane indicated by the line 15—15 of FIG. 12.
FIG. 16 is a view of the section at the plane indicated by the line 16—16 of FIG. 12.
FIG. 17 is a plan view of the fastening device made of two sections of wire connected through a spring-pivot arrangement, shown fastening a garment hanger hook to a clothesline.
FIG. 18 is a side elevational view of the device shown in FIG. 17.
FIG. 19 is a fragmentary plan view of the pivot end of the primary member having a part which acts as a pivot, being part of the device shown in FIG. 17.
FIG. 20 is a fragmentary side elevational view of that portion of the device shown in FIG. 19.

The fastening device can be provided with linear member retaining structure, 42, located outboard of the position occupied by the clothesline, 2, as shown in the device depicted in FIGS. 8 through 16. This linear member retaining structure functions as a limit stop to prevent movement of the clothesline, 2, away from its intended position in the fastening device, as shown in FIG. 8, in a direction away from the location where the primary members are connected together, at 43. In this embodiment, one of the jaws, 45, has a substantially radially oriented oriented generally slot shaped opening, 51, which accomodates the hook, 48, of the garment hanger within said slot shaped opening. This jaw, 45, and its slot shaped opening, 51, corresponds to the jaw, 7, and its slot shaped opening, 12, of the device shown in FIGS. 1 and 2 in that this jaw, 45, also has surface which normally contacts the undersurface of the linear member, 2. The linear member retaining structure, 42, is incorporated in the other jaw, 44, which does not necessarily contact the linear member, and this linear member retaining structure, 42, extends across so as to lie next to part of the jaw, 45, which contacts the linear member, 2, and thereby to be properly located to perform its retaining function. The linear member retaining structure in this device also functions as guide structure to restrict relative sideways, displacement of the jaws by virtue of the manner in which it overlaps part of the other jaw. The primary members in this embodiment are discrete and separate elements of the fastening device and these primary members are connected together with a mechanically hinged-type connection which employs a hinge pivot, 43. A coil-type spring, 46, is is installed with its axis located generally along the hinge pivot, 43, and this spring acts upon the primary members through tangential extensions, 47, to urge the jaws, 44 and 45, toward a closed position.

The jaw, 44, which does not necessarily contact the linear member, contacts the outer surface of the hook, 48, of the garment hanger at one location, 49, which is generally outboard of the position occupied by the clothesline, 2, and the jaw, 45, which normally contacts the linear member, 2, contacts the outer surface of the hook, 48, at one location, 50, which is generally inboard of the position occupied by the clothesline, 2. Here the slot shaped opening, 51, in the jaw, 45, which normally contacts the clothesline, 2, may be of sufficient length to accomodate the hook, 48, of the garment hanger at only one location, 52, where the hook, 48, passes through the slot shaped opening, 51, instead of in two locations, 26 and 27, as in the device shown in FIG. 2. When the generally slot shaped opening, 51, is shorter than the length required to accomodate the hook in two locations, it may be desireable that the jaw, 44, which does not necessarily contact the linear member, 2, have a lateral confinement element at the location, 49, where it contacts the hook, 48, of the garment hanger to hold the hook from being displaced sideways out of the jaw. This lateral confinement element, 49, in this jaw, 44, is generally formed as a concavity or opening, 53, in the jaw into which the hook is accomodated and which has generally lateral bounding surfaces situated transversely to the jaw, as shown in cross sectional view in FIG. 10, so that the hook will be held in the jaw and will be constrained from being displaced sideways out of the jaw. Because of its depth, it can be considered that this concavity or opening, 53, constitutes a slot shaped opening in its jaw, 44, thus providing a generally slot shaped opening in each of the two jaws. However, it should be noted that there is a fundamental difference between the slot shaped opening, 53, in the jaw, 44, with the lateral confinement element and the opening, 51, of the other jaw, 45. The slot shaped opening, 51, in the jaw, 45, which normally contacts the linear member, 2, extends into the jaw in a generally radial direction with respect to a circle centered on an axis through the hinge pivot, 43. The opening, 53, in the jaw, 44, with the lateral confinement element, extends into the jaw, 44, in a generally circumferential (or tangential) direction with respect to said circle centered on the axis through the hinge pivot, 43. Thus this jaw, 45, with the lateral confinement element, cannot accomodate the hook, 48, within its slot, 53, in a direction which extends into the jaw toward the hinge pivot, 43, and, as a result, it is forced to bear down on the hook and thereby clamp it to the linear member in opposition to the force exerted on the undersurface of the linear member, 2, by the jaw, 45, having the radially oriented slot shaped opening, 51.

The type of linear member retaining structure, 42, shown in FIG. 8, generally requires that the jaws, 44 and 45, of the fastening device open through a greater angle than in the devices previously described. The angular opening distance required generally amounts to more than 40 degrees and is needed to provide sufficient jaw opening for convenient installation of the device. To alleviate problems in manipulation of the device which might result from having the extending structure, 54, which forms the handles, 54, rotate through such a large angle, protruding structure, 55, may be added to these handles, 54, to assist in preventing the fingers from sliding in toward the hinge pivot, 43, when opening the jaws.

The design of this device is such that the two primary members can be made of molded plastic. FIG. 9 shows the primary member having the jaw, 44, which has the linear member retaining structure, 42, and FIGS. 10 and 11 show the cross section at two locations on this primary member. The primary member having the jaw, 45, which normally contacts the linear member is shown in FIG. 12. FIG. 13 shows a section through the jaw on this primary member at a location which includes the slot shaped opening, 51, and FIGS. 14 through 16 depict other cross sections of this primary member.

The fastening device can be made entirely of wire. An example of such construction is shown in FIGS. 17 through 20. Here each primary member is a discrete part of the device and is made of a separate piece of wire. A coil-type spring member formed of the wire of one of the two primary members provides a force which urges the jaws, 56 and 57, toward a closed position. In this example, the spring member is comprised of two spring coils, 58, one coil being formed at each end of the piece of wire of which a first one of the two primary members is made. Each spring coil has a tangential extension, 59, at the end of the coil which transmits the force of the spring member to the second of the two primary members. A part, 60, of that second primary member extends into the coil of the spring member and that part, 60, acts generally as a pivot within the coil for the hinged type angular relative motion between the two primary members. In this case, that pivot-acting part, 60, extends through both coils, 58, of the spring member and another part, 61, of the second primary member hooks to the pivot-acting part, 60, where it emerges from the spring coils. With this arrangement it can be seen that the forces exerted on the second of the two primary members by the tangential extensions, 59, of the spring coils, in addition to urging the jaws, 56 and 57, toward a closed position, also urges the pivot-acting part, 60, toward and against one side of the internal surface of the spring coils, 58, as shown in FIG. 18, and urges the other part, 61, which hooks to the pivot-acting part, 60, in a generally similar direction which will tend to keep the two parts hooked together. With this arrangement, the spring coils, 58, are retained on the pivot-acting part, 60, and the two primary members are hingedly connected together. Details of the pivot end of the primary member which has the pivot-acting part, 60, and the other part, 61, which hooks to the pivot-acting part, 60, are shown in FIGS. 19 and 20.

Another feature of the fastening device depicted in FIGS. 17 and 18 is that the sections, 62, of the primary members which are located between the pivot location, at 60, and the jaws, 56 and 57, can be squeezed together by hand to open the jaws, 56 and 57. This action is accomplished by having the primary members cross each other at a location, 63, which is inboard of the position occupied by the clothesline or linear member, 2. In this case, the primary member having the jaw, 56, which does not generally contact the linear member, 2, has a structure, 64, which accomplishes this crossing of this primary member at somewhere near a right angle to the other primary member. This structure, 64, also serves as guide structure in that it operates within two additional slots, 65, in the jaw with the generally slot shaped opening, one slot being on each side of the slot shaped opening, and this tends to restrict relative sideways displacement of the jaws, while allowing the jaws, 56 and 57, to open and close. This same structure, 64, also functions as blocking structure located inboard of the position occupied by the linear member, 2, since it extends across so as to lie next to a range of positions occupied by part of the jaw, 57, having the slot shaped opening and thus effectively blocks relative movement of the linear member away from its intended position in the fastening device, at 2, in a direction toward the location where the primary members are connected together, at 60.

Each of the jaws, 56 and 57, of the device shown in FIGS. 17 and 18, is made of a single piece of wire, the wire being continuous throughout each jaw and the ends of the wire being located elsewhere than in the jaw. The jaw, 57, which has the slot shaped opening, is formed by having the wire bent so as to enter the jaw region, at 66, and then continuing generally to the end, at 69, of the jaw, 57, (outboard end of the slot shaped opening) at which point it is bent in a generally reverse direction so as to proceed generally to the closed end, 68, of the slot shaped opening, all while remaining generally on one side of the position occupied by the hook, 48, of the garment hanger. At the closed end, 68, of the slot shaped opening, the wire is bent generally across to the other side of the slot shaped opening, at 68, at which point the wire is then bent in a similar, mirror image, manner on the other side of the position occupied by the garment hanger hook, 48, to complete the jaw. This jaw, 57, contacts the outer surface of the garment hanger hook, 48, at the closed end, 68, of the slot shaped opening. It should be noted that two additional slots, 65, one on each side of the slot shaped opening can be formed in this jaw as depicted and these additional slots can be used for accomodating and confining the guide structure, 64, as previously described. This jaw, 57, which has the generally slot shaped opening, can also be shaped so as to include linear member retaining structure, 69, located outboard of the position occupied by the clothesline or linear member, 2. This linear member retaining structure is usually a portion, 69, of the jaw, 57, which is bent or raised above the level of the surface on that jaw which contacts the linear member, 2. This linear member retaining structure, 69, functions to prevent relative movement of the linear member, 2, away from its intended position in the fastening device in a direction leading away from the location, at 60, where the primary members are connected together.

The jaw, 56, which does not normally contact the clothesline, is formed in a somewhat similar manner to the other jaw by having the wire bent so as to enter the jaw region, at 70, and then to continue generally to a location, at 67, on one side of the end of the jaw while generally remaining on one side of the position occupied by the garment hanger hook, 48. In the process of proceeding from the location, at 70, where the wire enters the jaw region to the end, at 67, of the jaw, the wire is also bent into any auxiliary structure which is incorporated in the jaw. In the device depicted in FIGS. 17 and 18, such auxiliary structure includes the structure, 64, which accomplishes the crossing of the primary members and also serves as the guide and blocking structure as previously described. When the wire reaches the location, at 67, at one side of the end of the jaw, it is bent generally across to the other side of the position occupied by the garment hanger hook, 48, to form the end of the jaw which contacts the outer surface of the garment hanger hook, 48. In forming the end of the jaw, 56, in this manner, the wire may also be bent so as to include a lateral confinement element, at 67, at the end of the jaw as shown in FIGS. 17 and 18, to constrain the garment hanger hook from being displaced sideways out of the jaw. After being bent across to form the end of the jaw, 56, the wire is then bent in a similar, mirror image, manner to complete the jaw. In this example, the wire proceeds from the guide structure, 64, to the end, at 67, of the jaw by passing within a short distance from the linear member, 2, on the opposite side of the linear member from the side making contact with the jaw, 57, having the slot shaped opening. By having linear member retaining structure, 69, incorporated in the jaw, 57, having the slot shaped opening and located outboard of the position occupied by the linear member, 2, it is possible to have this jaw, 57, limited in length to that necessary to accomodate the hook, 48, of the garment hanger at only one location, at 68, where the hook passes through the slot shaped opening as depicted in FIGS. 17 and 18, provided that the above mentioned lateral confinement element, at 67, is present in the other jaw, 56.

From the foregoing, it is clear that linear member retaining structure can be incorporated with either primary member in the jaw region of that primary member. Basically it is merely structure which is so shaped and positioned that, when the fastening device is in its fastening position, it forms a barrier to prevent relative movement of the linear member in at least one direction away from its proper position in the fastening device with respect to its distance from the location where the primary members are effectively connected together. When incorporated with the primary member which has the jaw which normally contacts the linear member, it comprises structure which extends above the level of the surface which contacts the linear member in that jaw to form such a barrier. When incorporated with the other primary member, it comprises structure which extends toward the jaw which normally contacts the linear member a sufficient distance to form such a barrier to block relative movement of the linear member when the fastening device is in its fastening position.

It is not necessary that the fastening device have handles for opening the jaws. The device can be configured so that it can merely be pushed into its fastening position by having at least one jaw provided with ramped entry structure so that the jaws will be spread apart sufficiently by contact with the clothesline, 2, and/or the garment hanger hook, 1, to allow installation as in the example depicted in FIGS. 21 and 22. Here the end, 71 and 72, of each jaw is bent away at an angle to form the ramped entry structure for this purpose. This device would work just about as well if only the end, 72, of the jaw having the generally slot shaped opening was provided with such ramped entry structure. This device is also an example of the entire fastening device, including both primary members, 73 and 74, being made of the same continuous piece of material, in this case, a piece of sheet metal. The primary members, 73 and 74, are connected together by a spring type connection which serves as the force producing member, at 75, comprising a spring, 75, formed of the same piece of material of which the primary members are made. This spring type connection allows for the generally hinged-type angular relative movement between the primary members, 73 and 74, and the spring, 75, provides a force acting on the primary members, 73 and 74, to urge the jaws toward a closed position.

In the fastening device so far presented, only one of the two jaws had a radially oriented slot shaped opening which allowed the jaw to accomodate the hook within the slot in a direction which extended into the jaw toward the hinge pivot. This, as has been noted, caused the other jaw to contact and apply pressure to the outer surface of the hook and it also caused the effective pivot for the two primary members to be positioned off to one side of the hook as is shown in the devices depicted in FIGS. 1–22. In contrast, each of the two jaws can be provided with a substantially radially oriented slot shaped opening which allows each of the two jaws to accomodate the hook within the respective slot in the jaw in a direction which extends into the jaw from the end of the jaw toward the hinge pivot. An example of such a fastening device is shown in FIGS. 23 and 24.

Here the slot shaped openings, 77, are generally at right angles to the normal opening formed between the jaws, 76, when they are opened. FIG. 25 shows a somewhat similar fastening device with modified jaws, 78 and 79, fastening a garment hanger hook, 48, to a clothesline, 2. FIG. 24 serves as a rotated view of the device shown in FIG. 25 in addition to being a rotated view of the device in FIG. 23.

The basic mode of operation of the fastening devices depicted in FIGS. 23 through 25 is shown in FIG. 25. The clothesline or other linear member, 2, is accomodated within the normal opening created between the jaws, 78 and 79, when the jaws are opening, while the hook, 48, of the garment hanger or other hook including device is positioned within the slot shaped openings, 77, above the clothesline, 2, and at approximately right angles to the clothesline. The hook, 48, is thus confined by the clothesline, 2, and the slot shaped openings, 77, while the clothesline, 2, is held in the grip of the jaws, 78 and 79. In these devices, the hinge pivot is generally located above the hook instead of being located off to one side of the hook as in the previously presented devices.

In the device shown in FIG. 23, the jaws, 76, when closed, form a generally and at least partially enclosing aperture, 80, to receive and hold the clothesline. In the modified jaws of the device shown in FIG. 25, one jaw, 78, has its internal surface generally in the shape of an "L" which contacts the clothesline, 2, at the side, 81, and at the end, 82, of the internal part of that jaw. This design allows the clothesline, 2, to be held by the side, 81, of the jaw while the end, 82, of the jaw holds the clothesline from being displaced endwise out of the jaw. The other jaw, 79, has surface, 83, which contacts the clothesline, 2, at the side, at 83, of the jaw and thus the two jaws, 78 and 79, act together to clamp the clothesline between the internal side surfaces, 81 and 83, of the jaws. This creates friction which tends to prevent the fastening device from sliding along the clothesline. The jaw, 79, which does not have the "L" shaped internal surface may carry its contacting surface, 83, on a projection, 84, which fits into the other jaw, 78, when the jaws are completely closed. This allows the contacting surfaces, 81 and 83, to come closer together in closing and thereby to be able to clamp thinner clotheslines than would be possible without such a projection. The spring, 85, and general mode of construction on the devices depicted in FIGS. 23 through 25 is similar to that found on the common spring clothespin.

A fastening device, in which there is a generally slot shaped opening in each jaw and in which both jaws normally contact the linear member, can be made to forcefully clamp the clothesline, 2, to the garment hanger hook, 48, as demonstrated by the device shown in FIGS. 26 through 29. In addition, each of the jaws, 87 and 88, have surfaces, 86, on the interior of the jaw, one such surface on each side of the slot shaped opening, which form inclined ramps which contact the clothesline, 2, as the jaws close and force it in an upward direction generally toward the hinge pivot, 90, and against the hook, 48, which, in turn, is restrained from further upward movement by its contact with the end of the slot, 89, in each jaw. In addition, each of the jaws, 87 and 88, have an inclined ramp, 86, on the interior of the jaw which contact the clothesline, 2, as the jaws close and force it in an upward direction generally toward the hinge pivot, 90, and against the hook, 48, which, in turn, is restrained from further upward movement by its contact with the end of the slot, 89, in each jaw.

These inclined ramps, 86, are generally at such an angle with respect to the relative direction of movement of the jaws in opening and closing that a clothesline or other linear member being contacted by these ramps receives a cam-like force tending to move it further in the direction toward the interior region of the fastening device. This device would also work generally in this manner if only one of the jaws had such inclined ramp surfaces and the other jaw was so shaped that it would merely exert a sideways force on the clothesline as the jaws close and thereby cause the clothesline to ride up on the inclined ramp surfaces on the jaw having such surfaces. This device, with either one or both of the jaws having such inclined ramp surfaces, would be effective in fastening and clamping two generally linear members together in a generally crossing relationship with one of the linear members lying in the slots in the jaws, as would be the case if the hanger hook, 48, in FIG. 26 was straightened out, and the other linear member being close to the position occupied by the clothesline, 2, in FIG. 26.

When the device is used for fastening a hook to a linear member, these inclined ramps generally provide for the accomodation of a larger range of different sizes of hanger hooks and clothesline diameters than would be the case if the angle of inclination of these surfaces was zero. However, this fastening device would still work for this purpose if this angle of inclination was zero as, for example, if the contacting surfaces, 86, of the jaws, 87 and 88, were parallel to the bottom or outboard surfaces, 91, of the jaws when referring to FIG. 26. Ther reason why it would work if the fastening device was configured in this manner is that the fastening device "rides" on the curved upper surface of the hook where it contacts the hook at the end of the slot shaped openings, 89, and this also creates a cam-like force tending to raise the fastening device up on the hook as the jaws close and thereby forcefully clamp the clothesline, 2, to the garment hanger hook, 48. In fact, there are several possible workable variations along these lines. For example, one jaw, 87, could have the contacting surface, 86, parallel to the bottom or outboard surface, 91, of that jaw and the other jaw, 88, could have nothing more than a contacting surface which contacts the outer surface of the hanger hook in order to make a stable and workable fastening device. And, to carry this one step further, the jaw, 87, having the contacting surface, 86, parallel to the outboard surface of that jaw, could, in addition, have a raised section or tip on the end of that jaw which extends generally further inboard from the contacting surface in order to present a fence or barrier which would be effective to retain the clothesline from slipping off that jaw. Further, it is not necessary that the end of the slot shaped opening, 89, be raised to the level depicted in FIG. 27. The end of this slot shaped opening could be approximately at the level of the bottom or outboard surface, 91, of the jaws and the device would still function to fasten a hook to a linear member.

The foregoing is considered as illustrative only of the principles of the invention. Further, since numerous modifications and changes will readily occur to those skilled in the art, it is not intended to limit the invention to the exact construction and operation described, and accordingly all suitable modifications and equivalents may be resorted to, falling within the scope of the invention as claimed.

What is claimed is:

1. A fastening device for fastening a hook to a generally linear member, to which the hook is hooked, comprising two primary members which are connected together to form a generally lever-type clip which permits generally hinged-type angular relative movement between the primary members; a pair of jaws, one jaw being so combined with each primary member that the two jaws are generally openable with respect to each other as a function of the generally angular relative movement between the primary members, one jaw having a generally slot shaped opening of sufficient width and extending a sufficient distance into the jaw to accomodate at least part of the hook when said fastening device is in its fastening position with respect to the hook and the linear member, the other jaw being without a primarily radially oriented generally slot shaped opening of sufficient size to accomodate the hook; means for biasing the jaws toward a generally closed position; and means, involving the shape of the jaws and their position with respect to the primary members, for clasping the hook and the linear member in their hooked-together position with the linear member passing transversely through the jaw region of the fastening device; whereby the fastening device can be put into a fastening position with respect to the hook and the linear member such that said slotted jaw accomodates the hook within its slot shaped opening and the jaws conjointly clasp the hook and the linear member, thereby constraining them to their hooked-together position.

2. The fastening device of claim 1 further comprising means for opening the jaws of the fastening device by squeezing sections of the device together with the hand prior to putting the fastening device in its fastening position with respect to the hook and the linear member.

3. The fastening device of claim 1 wherein said jaw which has said generally slot shaped opening, together with its generally slot shaped opening, is oriented primarily in a radial direction with respect to a circle centered on an axis through the location where the primary members are, in effect, hingedly connected together, wherein said jaw has two linear member contacting surfaces for contacting the undersurface of the linear member where it passes transversely through the jaw region of the fastening device, one such surface being on each side of said slot shaped opening, said surfaces being oriented such that the clamping direction of said jaw on the linear member is primarily circumferential with respect to said defined circle, said jaw being designated as the jaw which normally contacts the linear member; and wherein the other jaw has at least one surface for contacting the outer surface of the hook and for applying pressure thereon in a direction in general opposition to the clamping direction of the slotted jaw which contacts the linear member; whereby the fastening position of the fastening device with respect to the hook and the linear member is that in which at least part of the hook is positioned within the radially oriented slot shaped opening of the jaw which has such opening and the two linear member contacting surfaces of that jaw contact the undersurface of the linear member where the linear member passes transversely through the fastening device, the other jaw contacts the outer surface of the hook in at least one location so that the two jaws conjointly clamp the hook and the linear member together, and the location where the two primary are effectively connected together is generally positioned to one side of the hook.

4. The fastening device of claim 3 wherein the jaw, other than said jaw which normally contacts the linear member, is so shaped that it generally contacts the outer surface of the hook at one location which is generally about the same distance away from the location where the primary members are connected together as the position occupied by the linear member when the fastening device is in its fastening position.

5. The fastening device of claim 3 wherein the jaw, other than said jaw which normally contacts the linear member, is so shaped that it generally contacts the outer surface of the hook at two separated locations, one such location being generally inboard and the other such location being generally outboard of the position occupied by the linear member when the fastening device is in its fastening position.

6. The fastening device of claim 3 wherein the jaw, other than said jaw which normally contacts the linear member, is so shaped that it generally contacts the outer surface of the hook at one location which is generally outboard of the position occupied by the linear member when the fastening device is in its fastening position.

7. The fastening device of claim 3 wherein said jaw which normally contacts the linear member is so shaped that said jaw generally contacts the outer surface of the hook at one location which is inboard of the position occupied by the linear member when the fastening device is in its fastening position, said location where said jaw, which normally contacts the linear member, contacts the outer surface of the hook generally being at the inboard end of the slot shaped opening in said jaw.

8. The fastening device of claim 3 wherein the jaw, which normally contacts the linear member, is shaped so that it effectively includes a depression on the interior of the jaw, generally transverse to the jaw, in which the linear member contacting surfaces lie, to form linear member retaining structure for accomodating and holding the linear member in its proper relative position in said jaw when the fastening device is in its described fastening position.

9. The fastening device of claim 3 wherein the jaw, which normally contacts the linear member, and the generally slot shaped opening in that jaw are of sufficient length to accomodate the hook in only one location where said hook passes through the generally slot shaped opening, said location being generally inboard of the position occupied by the linear member when the fastening device is in its fastening position.

10. The fastening device of claim 3 wherein the jaw, which normally contacts the linear member, and the generally slot shaped opening in that jaw are of sufficient length to accomodate the hook at two locations where said hook passes through the generally slot shaped opening, one such locating being generally inboard and the other such location being generally outboard of the position occupied by the linear member when the fastening device is in its fastening position.

11. The fastening device of claim 3 further comprising guide structure connected to one primary member generally at a radial distance from the location where the primary members are connected together, said guide structure including surface which overlaps and lies next to at least a portion of a range of positions of surface on the other primary member as the jaws open and close, said guide structure thereby forming a guide which allows relative movement of the primary members of the fastening device in opening and closing the jaws but restricting relative sideways displacement of the jaws.

12. The fastening device of claim 3 wherein the primary member, which has the jaw which normally contacts the linear member, further comprises linear member retaining structure incorporated with that primary member in the jaw region of the device, said linear member retaining structure being structure which is located generally to one side of the position occupied by the linear member as it passes transversely through said jaw region when the fastening device is in its described fastening position and also being structure which extends above the level of the linear member contacting surfaces to form a barrier for preventing relative movement of the linear member in at least one direction away from its proper position in the fastening device with respect to its distance from the location where the two primary members are, in effect, hingedly connected together.

13. The fastening device of claim 3 wherein the primary member, other than the primary memer which has the jaw which normally contacts the linear member further comprises linear member retaining structure incorporated with that primary member in the jaw region of the device, said linear member retaining structure being structure which is located generally to one side of the position occupied by the linear member as it passes transversely through said jaw region when the fastening device is in its described fastening position and also being structure which extends generally toward the jaw which normally contacts the linear member a sufficient distance, when the fastening device is in its described fastening position to form a barrier to prevent relative movement of the linear member in at least one direction away from its proper position in the fastening device with respect to its distance from the location where the primary members are, in effect, hingedly connected together.

14. The fastening device of claim 10 further comprising linear member retaining structure which is incorporated with one one primary member in the jaw region of the device and which is positioned to form a barrier, when the fastening device is in its described fastening position, to prevent relative movement of the linear member in at least one direction away from its proper position in the fastening device with respect to its distance from the location where the primary members are, in effect, hingedly connected together.

15. The fastening device of claim 11 further comprising linear member retaining structure which is combined with said guide structure and connected to said first mentioned primary member, said linear member retaining structure being structure which is positioned, when the fastening device is in its described fastening position, to form a barrier to prevent relative movement of the linear member in at least one direction away from its proper position in the fastening device with respect to its distance from the location where the primary members are, in effect, hingedly connected together.

16. The fastening device of claim 3 wherein the jaw, other than the jaw which normally contacts the linear member, includes a lateral confinement element for the hook, said lateral confinement element being an opening in the jaw which has generally lateral bounding surfaces situated transversely in the jaw for accomodating and constraining the hook from being displaced sideways out of the jaw.

17. The fastening device of claim 3 wherein the jaw which normally contacts the linear member is made generally of a single piece of wire and wherein said jaw and its slot shaped opening are formed by having the wire bent so as to enter the jaw region, arriving generally from a location where it is united with a portion of the remainder of its respective primary member and arriving generally and approximately in a direction leading away from the location where the primary members are connected together and then continuing generally to the open end of the slot shaped opening which is generally and approximately at the end of the jaw while remaining generally on one side of the position occupied by the hook when the fastening device is in its fastening position, then generally being bent in a generally reverse direction so as to proceed generally to the closed end of the slot shaped opening while continuing to remain on the same side of said position occupied by said hook, then being bent generally across to the other side of the slot shaped opening so as to form the closed end of the slot shaped opening, said wire then being bent in a generally similar, mirror image, manner on said other side of the slot shaped opening and finally exiting the jaw region toward the second location where said wire is united with a portion of the remainder of its respective primary member.

18. The fastening device of claim 17 wherein the jaw which normally contacts the linear member and which has a generally slot shaped opening is formed to include an additional slot generally on each side of said slot shaped opening, said additional slot being formed generally between that portion of the wire which enters the jaw region as described in claim 17 and continues generally to the open end of the slot shaped opening which is generally and approximately at the end of the jaw and that portion of the wire which is then bent in a generally reverse direction and proceeds generally to the closed end of said slot shaped opening, said additional slot generally providing a confining region within which guide structure incorporated in the other jaw may operate and within which said guide structure will generally be restrained from relative sideways displacement.

19. The fastening device of claim 3 wherein the jaw, other than the jaw which normally contacts the linear member, is made of a single piece of wire and wherein said jaw is formed by having the wire bent so as to enter the jaw region, arriving generally from a location where it is united with a portion of the remainder of its respective primary member and arriving generally and approximately in a direction leading away from the location where the primary members are connected together, said wire then continuing generally to a location on one side of the end of said jaw while remaining generally on the same side of the position occupied by the hook when the fastening device is in its fastening position, and while also being bent in any auxiliary structure incorporated in said jaw, then being bent generally across to the side of said jaw which is on the other side of said position occupied by said hook and thereby forming the end of said jaw which generally contacts the outer surface of said hook, then being bent in a generally similar, mirror image, manner on the other side of said position occupied by said hook, and finally exiting the jaw region toward the second location where said wire is united with a portion of the remainder of said respective primary member.

20. The fastening device of claim 19 wherein the jaw, other than the jaw which normally contacts the linear member, is so shaped that it has guide structure, made of the same piece of wire of which the jaw is made, which crosses a part of the primary member having the jaw which normally contacts the linear member, the location where the guide structure makes this crossing being generally inboard of the position occupied by said linear member when the fastening device is in its fastening position; and wherein said wire extends from the guide structure generally toward the end of its own jaw, passing within a generally short distance from the linear member on that side of the linear member which is opposite to the side making contact with the jaw which normally contacts the linear member.

21. The fastening device of claim 1 wherein at least one jaw of the device has ramped entry structure which generally comprises an end section of the jaw which is angled outward toward the opening direction of the jaw, whereby the jaws of the fastening device can be opened sufficiently by contact of the jaws with the hook and the linear member during installation to allow the fastening device to be pushed into its fastening position without the necessity for opening the jaws by hand prior to putting the fastening device into its fastening position.

22. The fastening device of claim 1 wherein each primary member is a discrete element of the fastening device to the extent that it is a separate entity from the other primary member and wherein the connection between the primary members at the location where said primary members are connected together is generally a mechanically hinged-type connection.

23. The fastening device of claim 22 wherein the means for biasing the jaws toward a closed position is a generally coil-type spring with its axis located along the pivot of the hinged-type connection between the primary members, wherein said coil-type spring has a generally tangential extension at each end of the coil, each such extension being further bent at the end of the tangential part of the extension in a generally right angle bend so that each terminal end of the wire of the spring is approximately parallel to the axis of the spring and situated at a radial distance from the coiled part of said spring, and wherein the spring forms the hinge pivot for the primary members by having the spring and spring-attachment portion of the primary members shaped and assembled in a manner similar to the common spring clothespin.

24. The fastening device of claim 1 wherein a first one of the two primary members has a coil-type spring member united with that primary member, said spring member being positioned approximately at the location where the two primary members are connected together; wherein each primary member is a discrete element with respect to the other primary member and the two primary members are hingedly connected together; wherein said spring member is connected to the second of the two primary members in such manner and to such extent that the force of the spring member is transmitted to said second primary member to urge the jaws of the fastening device generally toward a closed position; and wherein a part of said second primary member extends into the coil of said spring member such that said part of said second primary member acts generally as a pivot within said coil for the generally hinged-type angular relative movement between the primary members.

25. The fastening device of claim 24 wherein said coil-type spring member is comprised of two spring coils, both of which are united with said first primary member, each spring coil having a generally tangential extension at the end of said coil through which the force of said spring coil is transmitted to said second primary member, said coils being positioned generally end to end with a common axis which is generally parallel with the hinge centerline; wherein the pivot-acting part of said second primary member which extends into the coil of said spring member, extends generally through both spring coils, said second primary member having an additional part which generally hooks to said pivot-acting part, which extends through said spring coils, at the approximate location where said pivot-acting part emerges from the spring coils; and wherein the force transmitted by the tangential extension at the end of each spring coil, in addition to urging the jaws of the fastening device toward a closed position, also urges said pivot-acting part, which extends through the spring coils, against one side of the internal surface of the spring coils and urges said other part of said second primary member, which generally hooks to said pivot-acting part, in a direction which will tend to keep said two parts hooked together, thereby retaining the spring coils on the pivot-acting part extending through the coils and hingedly connecting the two primary members together.

26. The combination set forth in claim 25, of the coil type spring member united with a first of two discrete primary members and the pivot-acting part and additional part, which hooks to the pivot-acting part, of a second of two discrete primary members, providing for hingedly connecting the two primary members together, being part of a generally clip type device.

27. The fastening device of claim 1 wherein both of the two primary members are made of the same continuous piece of material.

28. The fastening device of claim 27 wherein the means for biasing the jaws is a spring including member which is formed of the same continuous piece of material of which the two primary members are made and wherein said spring including member thereby accomplishes the connection between the primary members which allows the generally angular relative movement between the primary members.

29. The fastening device of claim 1 wherein at least one jaw is primarily circumferentially oriented in the fastening device, wherein said circumferential jaw has a generally slot shaped opening which is also primarily circumferentially oriented in the fastening device and which is of sufficient size to accomodate at least part of the hook when the fastening device is in its fastening position, wherein said circumferential jaw has surface on each side of the generally slot shaped opening for contacting the undersurface of the linear member where it passes transversely through the jaw region of the fastening device, said surface facing toward the interior region of the fastening device, generally toward a location near to where the primary members are connected together, wherein said circumferential jaw also has surface for contacting the outer surface of the hook, such surface on the jaw generally being at the inboard end of said slot shaped opening, and wherein the other jaw has surface for contacting the outer surface of the hook; whereby the fastening position of the fastening device with respect to the hook and the linear member includes said circumferential jaw contacting and applying clamping pressure to the undersurface of the linear member while also accomodating at least part of the hook within its slot shaped opening and contacting and applying clamping pressure to the outer surface of the hook, and the other jaw contacting and applying clamping pressure to the outer surface of the hook, with the generally hinged-type connection between the primary members being located generally above the hook, thereby clamping the hook and the linear member together.

30. The fastening device of claim 29 wherein at least one primarily circumferentially oriented jaw which has said surface for contacting the linear member where it passes transversely through the fastening device, has a raised section on that jaw which extends above said contacting surface to serve as a barrier for retaining the linear member from unwantedly slipping off that jaw.

31. The fastening device of claim 29 wherein at least one substantially circumferentially oriented jaw, which has linear member contacting surface facing the interior region of the fastening device as set forth therein, has such surface oriented at an acute angle to the exact circumferential direction of the jaw such that such surface effectively forms an inclined ramp in which the further inboard from the end of the jaw a surface point is located, the closer it is to the generally hinged-type connection between the primary members, and wherein the other jaw includes means for urging the linear member inboard along said inclined ramp when the fastening device is in its fastening position, whereby the closing of the jaws of the fastening device will cause a linear member passing transversely through the jaw region of the fastening device to be urged inward toward the interior region of the fastening device and thereby to be clampingly forced against the hook when the fastening device is in its fastening position.

32. A device for fastening an object to a generally linear member comprising the combination of a hook which is generally and at least temporarily connected to the object and a jawed openable clip, wherein the jawed openable clip comprises two primary members which are connected together to form a generally lever-type clip which permits generally hinged-type angular relative movement between the primary members; two jaws, one jaw being so combined with each primary member that the two jaws are generally openable with respect to each other as a function of the generally angular relative movement between the primary members, one jaw having a generally slot shaped opening of sufficient width and extending a sufficient distance into the jaw to accomodate at least part of the hook when the device is in its hereinafter described fastening position; means, involving the shape of the jaws and their position with respect to the primary members, for the jaws to clasp the hook and the linear member when said device is in its hereinafter described fastening position; and means for biasing the jaws toward a generally closed position; wherein the fastening position and assembled configuration of said device is that in which the object is at least temporarily connected to the hook, the hook is hooked to the linear member in the normal manner, and the jawed openable clip is positioned with respect to the hook and the linear member such that at least part of the hook is accomodated within the generally slot shaped opening of said jaw which has said opening, the linear member passes transversely through the jaw region of the clip with at least one jaw, that being said jaw having said slot shaped opening, being in proximity to the linear member, and the hook and the linear member are clasped by the jaws, thereby constraining them to their hooked-together position.

33. The device of claim 32 wherein each of the two jaws of the jawed openable clip has a generally slot shaped opening of a sufficient width and extending a sufficient distance into the jaw to accomodate at least part of the hook and wherein, when the device is in its fastening position and assembled configuration, at least part of the hook is accomodated within the generally slot shaped opening in each of the two jaws of the jawed openable clip.

34. The device of claim 32 wherein said jaw of the jawed openable clip which has said generally slot shaped opening, as well as said generally slot shaped opening, is substantially radially oriented in the jawed openable clip, wherein said jaw has two linear member contacting surfaces for contacting the undersurface of the linear member, one such surface being on each side of said slot shaped opening, such surfaces being oriented such that the clamping direction of said jaw on the linear member is primarily circumferential with respect to the clip, wherein the other jaw of the clip has at least one surface for contacting the outer surface of the hook and for applying pressure thereon in a direction in general opposition to the clamping direction of the slotted jaw on the linear member and wherein said other jaw is without a substantially radially oriented slot shaped opening of sufficient size to accomodate the hook, whereby the fastening position of the jawed openable clip with respect to the hook and the linear member includes said jaw having said generally slot shaped opening contacting and applying clamping pressure to the undersurface of the linear member while accomodating the hook within its slotted opening and the other jaw contacting and applying clamping pressure to the outer surface of the hook with the generally hinged-type connection between the primary members being located to the side of the hook, thereby clamping the hook to the linear member.

35. The device of claim 34 wherein the jawed openable clip has linear member retaining structure which is incorporated with one primary member in the jaw region of the clip and which is shaped and positioned to form a barrier, when the jawed openable clip is in its described fastening position, to prevent relative movement of the linear member in at least one direction away from its proper position in the jawed openable clip with respect to its distance from the location where the primary members are, in effect, hingedly connected together.

36. The device of claim 34 wherein said jaw of the jawed openable clip which has said generally slot shaped opening, and the generally slot shaped opening in that jaw, are of sufficient length to accomodate the hook at two locations where the hook passes through the generally slot shaped opening, one such location being generally inboard and the other such location being generally outboard of the position occupied by the linear member when the jawed openable clip is in its described fastening position.

37. The device of claim 36 wherein the jawed openable clip has linear member retaining structure which is incorporated with one primary member in the jaw region of the clip and which is shaped and positioned to form a barrier, when the jawed openable clip is in its described fastening position, to prevent relative movement of the linear member in at least one direction away from its proper position in the jawed openable clip with respect to its distance from the location where the primary members are, in effect, hingedly connected together.

38. The device of claim 32 wherein at least one jaw of the jawed openable clip is primarily circumferentially oriented in the jawed openable clip, wherein said circumferential jaw has a generally slot shaped opening which is also primarily circumferentially oriented in the jawed openable clip and which is of sufficient size to accomodate at least part of the hook, wherein said circumferential jaw has surface on each side of the generally slot shaped opening for contacting the undersurface of the linear member where it passes transversely through the jaw region of the clip, said surface facing toward the interior region of the clip, generally toward a location near to where the primary members are connected together, wherein said circumferential jaw also has surface for contacting the outer surface of the hook, such surface generally being at the inboard end of said slot shaped opening and wherein the other jaw has surface for contacting the outer surface of the hook; whereby the fastening position of the jawed openable clip with respect to the hook and the linear member includes said circumferential jaw contacting and applying clamping pressure to the undersurface of the linear member while also accomodating at least part of the hook within its slotted opening and contacting and applying clamping pressure to the outer surface of the hook, and the other jaw contacting and applying clamping pressure to the outer surface of the hook, with the generally hinged-type connection between the primary members being located generally above the hook, thereby clamping the hook and the linear member together.

39. The device of claim 33 wherein each of the two jaws of the jawed openable clip and each of the generally slot shaped openings in said jaws are substantially radially oriented in the jawed openable clip, wherein the jaws have means for clasping the linear member between them and wherein, in the fastening position and assembled configuration of said device, the connection between the primary members of the jawed openable clip is located generally above the hook, the hook is accomodated in the slot shaped opening of both jaws and the linear member is positioned below and is supporting the hook with the linear member passing transversely through the jaws and positioned substantially crosswise to the hook.

40. The jawed openable clip as set forth in claim 39 wherein each primary member is a discrete element of the clip to the extent that it is a separate entity from the other primary member and wherein the connection between the primary members is a mechanically hinged-type connection.

41. The jawed openable clip as set forth in claim 39 further comprising means for opening the jaws of the clip by squeezing sections of the clip together with the hand prior to putting the clip in said fastening position.

42. The device of claim 39 wherein the jaws of the jawed openable clip, when closed, form a generally and at least partially enclosing aperture to receive the linear member and to hold it confiningly.

43. The jawed openable clip as set forth in claim 39 wherein the internal surface of one jaw is generally and somewhat in the shape of an "L" in a view of the clip in which the generally angular relative movement between the primary members occurs and lies in the plane of the image, the vertical line of the "L" being generally and approximately parallel to a radial extending from the location where the primary members are connected together to that part of the jaw occupied by the linear member, and the bottom line of the "L" being generally and approximately perpendicular to said radial, said bottom line being that part of the "L" which is at the greatest distance from said location where the primary members are connected together; said internal surface of said jaw being thereby configured to contact the linear member generally at the side and at the end of the internal part of said jaw; and wherein the other jaw has surface which contacts the linear member generally only at the side of the internal part of said jaw, both jaws thereby acting together to apply a pinching force to the linear member between the jaws while that part of the first mentioned jaw corresponding to the bottom line of the "L" holds and prevents the linear member from being displaced endwise out of the jaw.

44. The jawed openable clip of claim 43 wherein the jaw which has surface which contacts the linear member generally only at the side of the internal part of the jaw, carries such surface on a projection which protrudes into and fits inside of the other jaw when the jaws are fully closed.

45. A method for fastening a hook to a generally linear member to which the hook is hooked in the normal manner comprising putting a jawed openable clip having a pair of jaws with a generally slot shaped opening in one jaw and surfaces in the jaws for conjointly grasping the hook and the linear member into a fastening position with respect to the hook and the linear member such that said slotted jaw accomodates the hook within its slot shaped opening and the jaws clasp the hook and the linear member, thereby constraining them to their hooked-together position.

46. A method according to claim 45 wherein the jawed openable clip has a generally slot shaped opening in each jaw and wherein, in performing the method, the clip is put into a position with respect to the hook and the linear member such that each slotted jaw accomodates the hook within its respective slot.

47. A method according to claim 45 wherein the slotted jaw and its generally slot shaped opening are substantially radially oriented in the jaw openable clip, wherein the other jaw does not have an effective substantially radially oriented slot shaped opening, and wherein the method, as restated in greater detail, comprises putting the clip into a position with respect to the hook and the linear member such that the slotted jaw accomodates the hook within its slot shaped opening and said jaw also bears up on the undersurface of the linear member, and the other jaw bears down on the outer surface of the hook, said method being accomplished by moving the clip into said position from a position generally to the side of the hook and the linear member, with the substantially radial direction of the slotted jaw generally pointing toward the hook and the linear member, thereby clamping the hook and the linear member together.

48. A method according to claim 47 wherein the slotted jaw is shaped so that it has a constant surface for contacting the outer surface of the hook, generally located at the inboard end of the slot shaped opening, and wherein, in performing the method, the clip is put into a position with respect to the hook and the linear member such that, in addition to the jaws contacting the hook and the linear member as set forth in claim 47, the slotted jaw also contacts the outer surface of the hook at said contact surface on said jaw.

49. A method according to claim 47 wherein the jawed openable clip has means for opening the jaws of the clip by hand before installing the clip in its fastening position and wherein the method includes the act of opening the jaws of the clip by manipulating the clip with the hand before putting the clip into the therein described position with respect to the hook and the linear member.

50. A method according to claim 47 wherein the jawed openable clip has means for opening the jaws of the clip by contact of the clip with the hook and the linear member as it is being put into its fastening position and wherein the method is accomplished by forcefully moving the clip into the therein specified position so as to cause the jaws to open sufficiently, by contact of the clip with the hook and the linear member, to allow the clip to be forced into said position.

51. A method according to claim 45 wherein said slotted jaw and its generally slot shaped opening are substantially circumferentially oriented in the jawed openable clip and wherein the method, as restated in greater detail, comprises putting the clip into a position with respect to the hook and the linear member such that said slotted jaw accomodates the hook within its slot shaped opening, said jaw bears down on the outer surface of the hook and it also bears up on the undersurface of the linear member, and the other jaw bears down on the outer surface of the hook, thereby clamping the hook and the linear member together.

52. A method according to claim 46 wherein each slotted jaw and its generally slot shaped opening are substantially radially oriented in the jaw openable clip and wherein the method, as restated in greater detail, comprises putting the clip into a position with respect to the hook and the linear member such that each slotted jaw accomodates the hook within its respective slot shaped opening, generally within the inboard end of each opening, and the jaws conjointly clasp and hold the linear member between them with the liner member being positioned outboard of the hook within the jawed openable clip, said method being generally accomplished by moving the clip down into said position from above the hook and the linear member with the substantially radial direction of the jaws generally pointing downward toward the hook and the linear member (when considering that the hook hangs downward normally from the linear member).

53. A method according to claim 52 wherein the jawed openable clip has means for opening the jaws of the clip by hand before installing the clip in its fastening position and wherein the method includes the act of opening the jaws of the clip by manipulating the clip with the hand before putting the clip into the therein described position.

54. A method according to claim 52 wherein the jawed openable clip has means for opening the jaws of the clip by contact of the clip with the linear member as it is in the process of being put into its fastening position, and wherein the method is accomplished by forcefully moving the clip into the therein specified position so as to cause the jaws to open sufficiently, by contact of the clip with the linear member, to allow the clip to be forced into said position.

55. A method for fastening two generally linear members together in a generally crossing relationship according to the method of claim 1 for fastening a hook to a linear member as applied, instead, to two linear members, wherein, in performing the method, said jawed openable clip is put into a position with respect to the two linear members, which are arranged in a generally crossing relationship, such that said slotted jaw accomodates the linear member closest to the installing side of the clip within its generally slot shaped opening and the other linear member is accomodated and held in a transverse relationship to the jaws, thereby fastening the two linear members together in a generally crossing relationship.

56. A method for fastening two generally linear members together in a generally crossing relationship according to the method of claim 46 for fastening a hook to a generally linear member as applied, instead, to two linear members wherein, in performing the method, said jawed openable clip, having a slot in each jaw, is put into a position with respect to the two linear members, which are arranged in a generally crossing relationship, such that the linear member closest to the installing side of the clip is accomodated within the slot in each of the two jaws and the other linear member is accomodated and held in a generally transverse relationship to the jaws, thereby fastening the two linear members together in a generally crossing relationship.

57. A method for fastening two generally linear members together according to the method of claim 56 wherein the jawed openable clip has inclined ramp surfaces on the interior of at least one jaw which are oriented and positioned such that a linear member which is accomodated in a generally transverse position in that jaw is urged in a direction toward the interior region of the clip as it moves further inboard from the end of that jaw, wherein the other jaw has means for urging the linear member inboard on said inclined ramp surfaces and wherein the performance of the method includes putting the jawed openable clip into the position with respect to the two linear members as described in claim 56 such that said linear member which is accomodated and held in the generally transverse relationship to the jaws, is contacted and urged toward the interior region of the clip by said inclined ramp surfaces, the result thereby being that a clamping force is applied to the two linear members to clamp them together when the jaws close.

* * * * *